United States Patent [19]

Damrau

[11] 4,369,731

[45] Jan. 25, 1983

[54] COATING APPARATUS HAVING AN INTERNAL LEVELING BLADE

[75] Inventor: Wayne A. Damrau, Wisconsin Rapids, Wis.

[73] Assignee: Consolidated Papers, Inc., Wisconsin Rapids, Wis.

[21] Appl. No.: 298,762

[22] Filed: Sep. 2, 1981

[51] Int. Cl.[3] ..... B05C 5/02

[52] U.S. Cl. ..... 118/410; 118/413

[58] Field of Search ..... 118/407, 410, 411, 413, 118/405, 427; 427/356, 358

[56] References Cited

U.S. PATENT DOCUMENTS

| | | | |
|---|---|---|---|
| 2,038,607 | 4/1936 | Sauer | 118/413 X |
| 4,009,657 | 3/1977 | Bonanno et al. | 101/366 X |
| 4,250,211 | 2/1981 | Damrau et al. | 118/413 X |

FOREIGN PATENT DOCUMENTS

| | | | |
|---|---|---|---|
| 915328 | 1/1963 | United Kingdom | 427/356 |

*Primary Examiner*—John P. McIntosh

*Attorney, Agent, or Firm*—Gary, Juettner & Pyle

[57] ABSTRACT

An applicator for applying a film of coating material on a web of moving paper carried through an application zone and having a coater blade for doctoring the material on the web as it exits the zone, includes an internal leveling blade within the application zone. The leveling blade divides the application zone into leading and lagging coating material application chambers, and levels the material applied on the web in the leading chamber as the web moves into the lagging chamber. The leveling blade produces a pressure and shear point of coating material to paper so as to cause coating penetration and filling of voids and valleys in the paper, and the coater blade then levels and meters the film of fresh coating applied on the web in the lagging chamber to complete the process.

4 Claims, 1 Drawing Figure

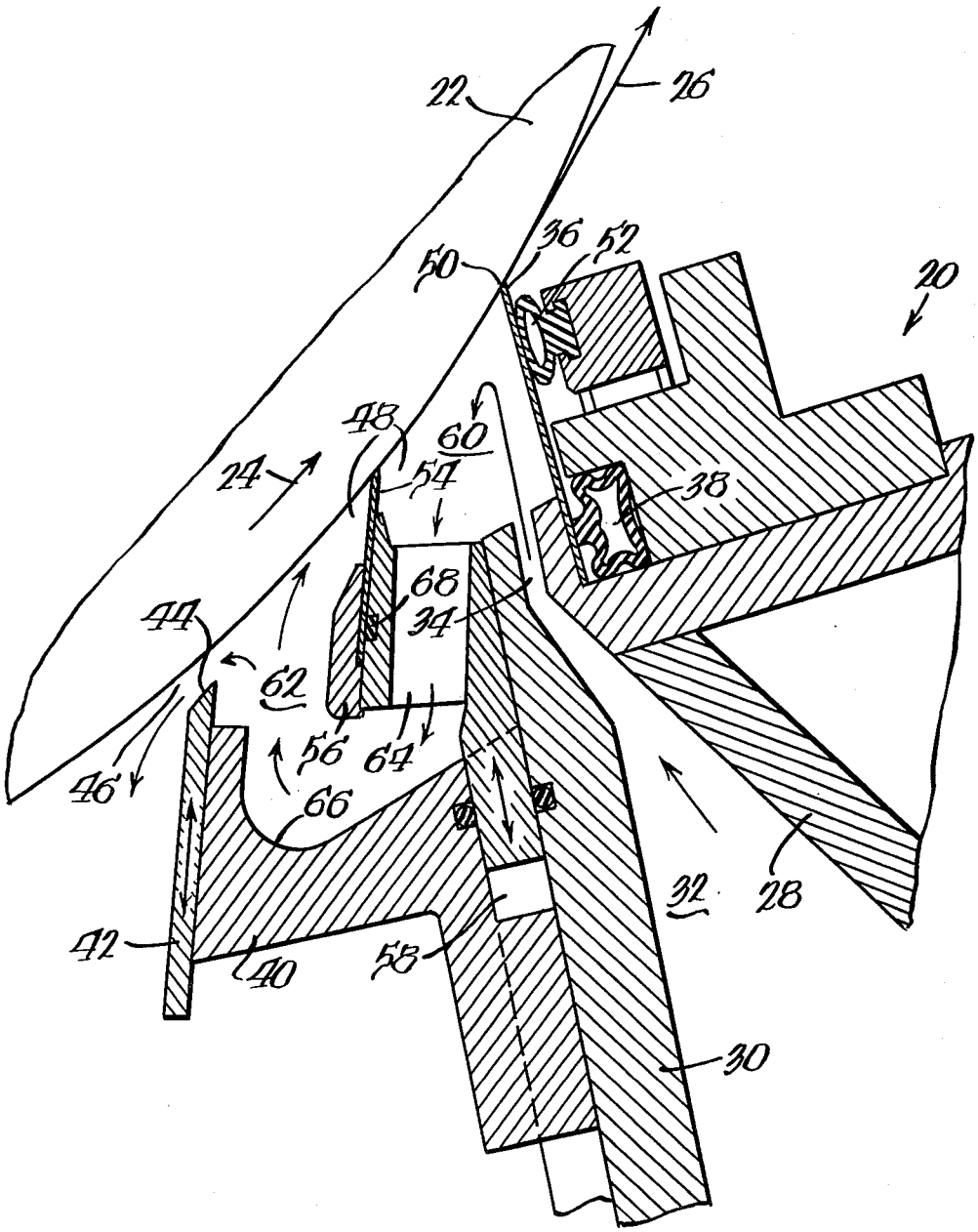
22
26
36
52
50
20
48
60
24
54
38
68
34
44
62
56
64
46
66
32
28
42
40
58
30

COATING APPARATUS HAVING AN INTERNAL LEVELING BLADE

BACKGROUND OF THE INVENTION

The present invention relates to a method and apparatus for applying a coating material to a moving web of paper, and in particular to a coating method and apparatus of the trailing blade type which includes an internal leveling blade upstream of the trailing blade.

Conventional coaters of the trailing blade type include means for applying coating material to a paper web that is usually supported and carried by a resilient backing roll, together with a flexible coater blade located on the trailing side of the applicator, which serves to doctor or level the applied coating. In general, an excess of coating material is applied on the web, and the coater blade then meters or removes the excess while uniformly spreading the coating onto the web surface.

In recent years, it has become desirable to produce papers having a minimum amount of coating. To achieve low coat weights with conventional trailing blade equipment, it is necessary to increase the pressure of the coater blade against the web, which results in a high rate of wear of the blade and necessitates more frequent replacement of the blade. High blade pressure also increases the possibility of web breakage and streaking caused by foreign particles being caught between the blade and web.

Conventional coaters inherently employ a relatively long dwell or soak time, which is the time interval between the initial application and final blading of the coating. As a result, the water portion of the coating composition, as well as the water soluble or dispersible materials contained therein, migrate into the moving web at a more rapid rate than the pigment and eventually cause an undesirable imbalance in the coating constituents and their rheological properties. Long soak periods are also incompatible with the application of successive web coats without intervening drying because the successive coats tend to migrate into and contaminate the previous coat.

To overcome the disadvantages of the aforementioned applicators in applying lightweight coatings on paper, there has been developed a short dwell time applicator, as disclosed in U.S. Pat. No. 4,250,211, assigned to the assignee of the present invention. In that applicator, means is provided with an upper outlet slot through which coating material is introduced into a relatively narrow application zone for being applied in excess on a web carried therethrough. The coating material in the application zone and as applied to the web is maintained under pressure, and the speed of the web is adjusted for a relatively short dwell time. A flexible coater blade doctors the web at the downstream end of the application zone, thereby removing excess material from the web and at the same time uniformly spreading the material on the web. In consequence of the short dwell time and the pressurized application of coating material on the web, an appropriate yet lightweight amount of coating material may be applied on the web without the need for high blade pressures.

A difficulty occasionally encountered in use of conventional applicators as well as those of the type disclosed in said U.S. Pat. No. 4,250,211 is that, depending upon the nature of the paper and coating material and the amount of material to be applied on the web, the coating may fail to properly penetrate and fill voids and valleys in the surface of the web. When this occurs, the quality of the coating is impaired.

OBJECTS OF THE INVENTION

An object of the present invention is to provide a short dwell time applicator or paper coating apparatus, with which improved coating material penetration and filling of voids and valleys in a paper web are obtained.

Another object is to provide such an applicator which includes an internal leveling blade within a coating material application zone, the leveling blade being upstream of a downstream coater blade.

A further object is to provide such an applicator in which the internal leveling blade divides the application zone into upstream and downstream portions, such that the leveling blade levels coating material applied to the web in the upstream portion prior to the web passing into the downstream portion.

SUMMARY OF THE INVENTION

In accordance with the present invention, in an apparatus for applying a coating liquid to at least one face of a moving web of paper, wherein said apparatus has a body portion having a chamber therein and an elongate opening to said chamber positionable generally adjacent to and transversely of the web and a coater blade extending from a rear or downstream side of said chamber opening substantially across and against the web, and wherein said chamber receives coating liquid under pressure and directs the same through said opening onto the web and said coater blade doctors the coating liquid on the web, there is provided the improvement comprising a leveling blade extending from said chamber opening intermediate said downstream side and a front or upstream side thereof substantially across and against the web. Said leveling blade levels coating liquid applied on the web upstream thereof to cause coating penetration and filling of any voids and valleys in the web, said coater blade then doctors coating liquid applied on the web downstream of said leveling blade.

The invention also contemplates an improved method of applying coating liquid to a moving paper web, which includes the steps of applying coating liquid to one surface of a web moving through an application zone having spaced front or upstream and rear or downstream edges and laterally spaced side edges; maintaining a reservoir of coating liquid on the web in the application zone between the front, rear and side edges thereof; and doctoring the coating liquid on the web at the downstream edge of the application zone, wherein the improvement comprises the step of leveling the coating liquid on the web in the application zone and intermediate the upstream and downstream edges thereof. Said leveling step causes coating penetration and filling of any voids and valleys in the web.

The foregoing and other objects, advantages and features of the invention will become apparent upon a consideration of the following detailed description, when taken in conjunction with the accompanying drawing.

BRIEF DESCRIPTION OF THE DRAWING

The single drawing figure illustrates a short dwell time applicator for applying a coating to a moving web of paper, which includes an internal leveling blade in accordance with the teachings of the present invention.

DETAILED DESCRIPTION

Referring to the drawing, there is shown an applicator or coater portion of a paper coating machine, having an internal leveling blade in accordance with the teachings of the invention. The applicator comprises a main beam, indicated generally at 20, extending parallel to and coextensively with a movable support or backing roll 22 which rotates in the direction shown by an arrow 24 and supports a web of paper 26 during its travel through an application zone. The beam has rear and front walls 28 and 30 forming a chamber 32 therebetween for reception of liquid coating material under pressure from a source of material (not shown), and the walls converge upwardly toward one another and define a metering slot 34 which extends upwardly adjacent to and facing the web support surface of the roll 22. Although not shown, the front wall is pivotally mounted relative to the rear wall to permit the chamber 32 to be opened for cleaning and also to adjust the width of the metering slot 34.

A flexible doctor or coater blade 36 at the downstream of the application zone is held against a rearward surface of the wall 28 by a pneumatic tube 38 which is expandable by the introduction of fluid under pressure therein to press against the blade. The coater blade extends beyond the metering slot 34 into engagement with the web supported on the roll and serves to meter and level the coating applied on the surface of the web. An orifice plate support 40 is mounted on the front wall 30, and adjustably supports an orifice plate 42 which converges toward the roll supported web and the coater blade. The orifice plate has a free edge 44 which is juxtaposed to but spaced slightly from the web, such that a space 46 between the edge and the web is relatively small and less than one inch.

At the two ends of the coater, the spaces between the coater blade 36 and the orifice plate 42 are sealed off in a manner known in the art by flexible edge dams (not shown), which seal with the upper edges of the walls 28 and 30 and the orifice plate support 40, the blade 36, the orifice plate 42 and the roll supported web 26, thereby to define a coating material application zone 48 downstream from the chamber 32 and the metering slot 34.

In operation of the applicator thus far described, coating liquid is introduced under sufficient pressure and in sufficient quantity to completely fill the chamber 32, the metering slot 34 and the application zone 48 defined by the doctor blade 36, the orifice plate 40 and the end dams, to cause a continuous, copious flow of coating material reversely of the direction of web travel through the narrow space or gap 46 defined between the upper end 44 of the orifice plate and the web. This forms a liquid seal between the edge and the web and causes the coating liquid to be applied to the web in a very narrow transverse band under a constant positive pressure. The copious excess of coating liquid that flows through the orifice gap 46 reversely of the direction of web travel forms a non-abrasive liquid seal with the web at the upstream or forward edge of the coating application zone; causes the coating liquid in the application zone to be maintained under pressure and to be applied to the web under pressure; seals off the forward edge of the application zone against entry of air and foreign matter; strips air from the high speed web and prevents such air from causing streaks or skips in the coating on the web; and causes the downstream coater blade 36 to doctor the coating liquid while the liquid is held under pressure.

The coating applicator thus far described is of the type disclosed in detail in aforementioned U.S. Pat. No. 4,250,211, assigned to the assignee of the present invention, and the teachings of which are specifically incorporated herein by reference. For a more specific description of the applicator, reference is made to said patent.

A doctoring tip 50 of the coater blade 36 is beveled or honed to an angle, which is the operating angle of the blade. The lower end of the blade is clamped in its seat by the pneumatic tube 38, and the bevel is preferably maintained flat or tangential to the web 26 at its point of contact, and to this end adjustment means (not shown), but as described in said U.S. Pat. No. 4,250,211, are provided for adjusting the angular orientation of the coater head or main beam 20 with respect to the web. The blade tip 50 is urged or loaded against the roll supported web by a second pneumatic tube 52 toward the upper end of the blade, and the amount, quantity or weight of coating applied to the web is influenced by the force of the blade tip against the web and by the angle that the tip makes relative to the web.

The applicator is generally referred to as a short dwell time applicator. That is, to avoid saturation of the web with coating material, thereby to prevent the water portion of the coating composition as well as the water solution or dispersible materials contained therein from migrating into the web at a more rapid rate than the pigment, the web is exposed to the coating material in the application zone 48 for only a relatively short time. To this end, the width of the application zone in the direction of web travel, as well as the speed of travel of the web through the zone, are controlled to provide a relatively short dwell time of the web within the zone. However, a difficulty which occasionally is encountered is that, depending upon the nature of the paper web and the coating composition, the coating may fail to fully penetrate and fill voids and valleys in the surface of the web.

To overcome the aforementioned disadvantage, an internal leveling blade 54 is provided within the application zone 48 for leveling coating material applied on the web while the web is within the zone. The leveling blade is supported by a blade holder 56, which in turn is adjustably carried within a slot 58 between the front wall 30 and the orifice plate support 40 for movement toward and away from the web, thereby to bring the leveling blade 54 into engagement with the web with a selected force. The leveling blade and its holder divide the application zone 48 into a leading or downstream application zone or chamber 60 and a lagging or upstream application zone or chamber 62, with communication between the downstream and upstream chambers being established through a plurality of elongated slots 64 formed through and transversely of the leveling blade holder.

In operation of the applicator as modified by the provision of the internal leveling blade 54 and its holder 56, coating liquid is supplied under sufficient pressure and in sufficient quantity to completely fill the chamber 32, the metering slot 34 and the downstream application chamber 60 defined by the downstream coater blade 36, the internal leveling blade and its holder and the end dams, thereby to completely fill the downstream application chamber with a supply of coating material for application on the surface of the web. Excess coating material exits from the downstream chamber through the slots 64 and into the upstream application chamber 62 to completely fill the chamber 62 with a supply of coating material, with curved wall areas 66 of the orifice plate support 40 causing the coating material to be directed upward to thoroughly wet the web within the application chamber. The material supplied through the metering slot 34 has a continuous, copious flow, thereby to cause a continuous and copious flow of coating material out of the upstream application zone and reversely of the direction of web travel through the narrow space or gap 46 defined between the upper end 44 of the orifice plate 42 and the web. This forms a liquid seal between the edge of the web, and causes the coating liquid to be applied to the web within the upstream and downstream application chambers 62 and 60 in a narrow transverse band.

Thus, as the paper web 26 travels through the application zones in the direction indicated by the arrow 24, it receives an initial coating on its surface within the upstream application chamber 62, which coating is leveled by the internal leveling blade 54 as the web moves from the upstream chamber and into the downstream chamber 60. Consequently, by the time the web enters the downstream application zone it has already been coated and leveled once. Then, within the downstream application chamber, the web receives on its surface a further coating, which is doctored by the coater blade 36 as the web exits from the downstream zone.

Because of the internal leveling blade 54, during the relatively limited time of passage through the application zone 48 coating material is twice applied and leveled on the web. The internal leveling blade levels the initial coating applied in the upstream application chamber 62, and produces a pressure and shear point of coating material to paper which causes improved coating penetration and filling of voids and valleys in the web to occur. A second coating is then applied to the web within the downstream chamber 60, whereafter the coater blade 36 meters and levels the film of fresh coating on the previously coated and leveled web to complete the coating process. Double blading in one operation produces a very uniform and smooth coated surface on the web, and if desired a somewhat denser coating layer may be provided on the web without the disadvantage of subjecting the web to a prolonged dwell or soak time.

As previously described, the edge dams seal with, among other items, the downstream coater blade 36 and the orifice plate 42. Therefore, to define the generally discrete downstream and upstream application chambers 60 and 62, the internal leveling blade 54 and its holder 56 are of a length transversely of the web to substantially abut the inside surfaces of the edge dams at opposite ends of the application zones. The internal leveling blade is held within its holder by detents 68, whereby with one edge dam removed the blade may conveniently be removed for inspection or replacement simply by sliding it laterally out of its holder. The coater blade 36 may be removed in a similar manner, except that the pressure within the pneumatic tubes 38 and 52 would first be relieved to release the blade.

While one embodiment of the invention has been described in detail, various modifications and other embodiments thereof may be devised by one skilled in the art without departing from the spirit and scope of the invention, as defined in the appended claims.

What is claimed is:

1. In an apparatus for applying a coating liquid to at least one face of a moving web of paper, wherein said apparatus has a body portion having a chamber therein and an elongate opening to said chamber positionable generally adjacent to, below and transversely of the web and a coater blade extending from a rear or downstream side of said chamber opening substantially across and against the web, said chamber for receiving coating liquid under pressure and directing the same upwardly through said opening onto the web and said coater blade doctoring the coating liquid on the web, the improvement comprising a housing mounted on said body portion in said chamber intermediate said downstream side and an upstream side of said chamber opening and extending below and transversely across the web, and a leveling blade supported in and extending transversely along an upper end of said housing and extending upwardly through said chamber opening intermediate said downstream side and said upstream side thereof substantially across and against the web, said leveling blade leveling coating liquid applied on the web upstream thereof to cause coating penetration and filling of any voids and valleys in the web, said coater blade then doctoring coating liquid applied on the web downstream of said leveling blade, said leveling blade and said housing dividing said opening into an upstream coating liquid application zone between said upstream side of said opening and said leveling blade and housing and a downstream coating liquid application zone between said leveling blade and housing and said coater blade, said coating liquid in said chamber being introduced into said downstream application zone and said housing having at least one passage extending therethrough and providing communication between said downstream and upstream application zones for a flow of coating liquid from said downstream to said upstream application zone.

2. In an apparatus as in claim 1, wherein said body portion at said upstream side of said chamber opening is spaced from and forms a gap with the web thereat and a copious amount of coating liquid is introduced from said chamber into said downstream application zone for flow through said at least one housing passage to completely fill said downstream and upstream application zones and to substantially completely and continuously fill said gap with coating liquid to form a liquid seal between the web and said body portion at said upstream side of said chamber opening.

3. In an apparatus as in claim 1, wherein said at least one housing passage comprises a plurality of passages extending through said housing between said downstream and upstream application zones, said passages being spaced along said housing transversely of the web, and said body portion has a curved surface in the upstream application zone portion of said opening and below the web and said plurality of housing passages direct coating liquid from said downstream application zone onto said curved surface, said curved surface directing the coating liquid upwardly into said upstream application zone and against the web.

4. In an apparatus as in claim 1, wherein said housing is adjustably mounted on said body portion for controlled movement away from and toward the web to move said leveling blade away from and against the web with a selected force.

* * * * *